US008635943B2

(12) United States Patent
Matsuo et al.

(10) Patent No.: US 8,635,943 B2
(45) Date of Patent: Jan. 28, 2014

(54) PISTON WITH BLOW-BY FEATURE AND METHOD OF PREVENTING CATASTROPHIC FAILURE TO AN INTERNAL COMBUSTION ENGINE

(75) Inventors: Eduardo H. Matsuo, Ann Arbor, MI (US); Kai Wang, Ann Arbor, MI (US)

(73) Assignee: Federal-Mogul Corporation, Southfield, MI (US)

( * ) Notice: Subject to any disclaimer, the term of this patent is extended or adjusted under 35 U.S.C. 154(b) by 697 days.

(21) Appl. No.: 12/943,283

(22) Filed: Nov. 10, 2010

(65) Prior Publication Data

US 2011/0107910 A1 May 12, 2011

Related U.S. Application Data

(60) Provisional application No. 61/259,814, filed on Nov. 10, 2009.

(51) Int. Cl.
*F01B 31/08* (2006.01)

(52) U.S. Cl.
USPC ..... 92/186; 92/181 R

(58) Field of Classification Search
USPC ..... 92/181 R, 186; 29/888.045
See application file for complete search history.

(56) References Cited

U.S. PATENT DOCUMENTS

| | | | | |
|---|---|---|---|---|
| 1,788,941 | A | 1/1931 | Bradley et al. | |
| 2,435,343 | A | 2/1948 | Downey | |
| 2,872,909 | A | 2/1959 | Stout | |
| 3,394,634 | A | 7/1968 | Pfundt | |
| 4,154,207 | A | 5/1979 | Brehob | |
| 5,086,736 | A * | 2/1992 | Wiemann | 92/186 |
| 5,737,999 | A | 4/1998 | Ariga | |
| 6,119,647 | A | 9/2000 | Sytsma | |
| 6,691,666 | B1 * | 2/2004 | Berr et al. | 92/186 |
| 6,789,460 | B2 * | 9/2004 | Kohnert | 92/186 |
| 2009/0288632 | A1 | 11/2009 | Scharp | |

FOREIGN PATENT DOCUMENTS

| | | | |
|---|---|---|---|
| DE | 31 06 542 | A1 | 10/1982 |
| DE | EP 0 086 284 | A1 | 8/1983 |
| DE | 102007012528 | A1 | 9/2008 |
| JP | 6248918 | | 9/1994 |

* cited by examiner

*Primary Examiner* — Michael Leslie
(74) *Attorney, Agent, or Firm* — Robert L. Stearns; Dickinson Wright, PLLC

(57) ABSTRACT

A piston and method is provided that inhibits the potential catastrophic damage to an internal combustion engine, thereby reducing the risk of costly damage to the engine. The piston includes a piston body having an upper combustion surface separated from an internal cooling chamber by a wall. The a pocket extends into the upper combustion surface to a closed bottom surface of the wall. A tubular member is disposed in the pocket. The tubular member extends upwardly from the upper surface. Should a valve head drop from its normal operating position, the valve head impacts the tubular member and forms a blow-by through passage extending from the upper combustion surface into the cooling chamber.

21 Claims, 2 Drawing Sheets

PISTON WITH BLOW-BY FEATURE AND METHOD OF PREVENTING CATASTROPHIC FAILURE TO AN INTERNAL COMBUSTION ENGINE

CROSS-REFERENCE TO RELATED APPLICATION

This application claims the benefit of U.S. Provisional Application Ser. No. 61/259,814, filed Nov. 10, 2009, which is incorporated herein by reference in its entirety.

BACKGROUND OF THE INVENTION

1. Technical Field

This invention relates generally to internal combustion engines, and more particularly to pistons therefor.

2. Related Art

A known potential failure mode of an internal combustion engine results when a valve drops into contact with the piston during operation, which can result in catastrophic failure of the engine. The damage resulting to the engine can include replacement of the entire power cylinder system (piston, rings, liner, wrist pin, connecting rod), valve train, cylinder head, crankshaft, and many times, the engine block. Accordingly, although repairable, the cost to repair a failure mode of this nature can be very expensive.

SUMMARY OF THE INVENTION

A piston is provided that inhibits the potential catastrophic damage to an internal combustion engine, thereby reducing the risk of costly damage to the engine. The piston includes a piston body having an upper surface separated from an internal cooling chamber by a wall. The upper surface has a pocket extending to a closed bottom surface of the wall. A tubular member is disposed in the pocket. The tubular member extends upwardly from the upper surface.

In accordance with another aspect of the invention, a method of preventing catastrophic failure to an internal combustion engine is provided. The method includes providing a piston body having an upper surface separated from an internal cooling chamber by a wall. And, providing predetermined locations in the wall underneath valve heads for a through opening to be formed through the wall into the internal cooling chamber in use.

In accordance with another aspect of the method, the method further includes forming a pocket extending into the upper surface to a closed bottom surface of the wall and disposing a tubular member in the pocket with the tubular member extending upwardly from the upper surface.

In accordance with another aspect of the invention, a method of preventing catastrophic failure to an internal combustion engine is provided by providing a predetermined location in a upper wall of a piston for a valve head to impact to form a blow-by passage extending into an internal cooling chamber of the piston. The blow-by passage provides a sudden increase in blow-by, thereby providing an immediate indication of a problem. The indication is utilized to prevent further damage from resulting to the engine.

BRIEF DESCRIPTION OF THE DRAWINGS

These and other aspects, features and advantages of the invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 1:
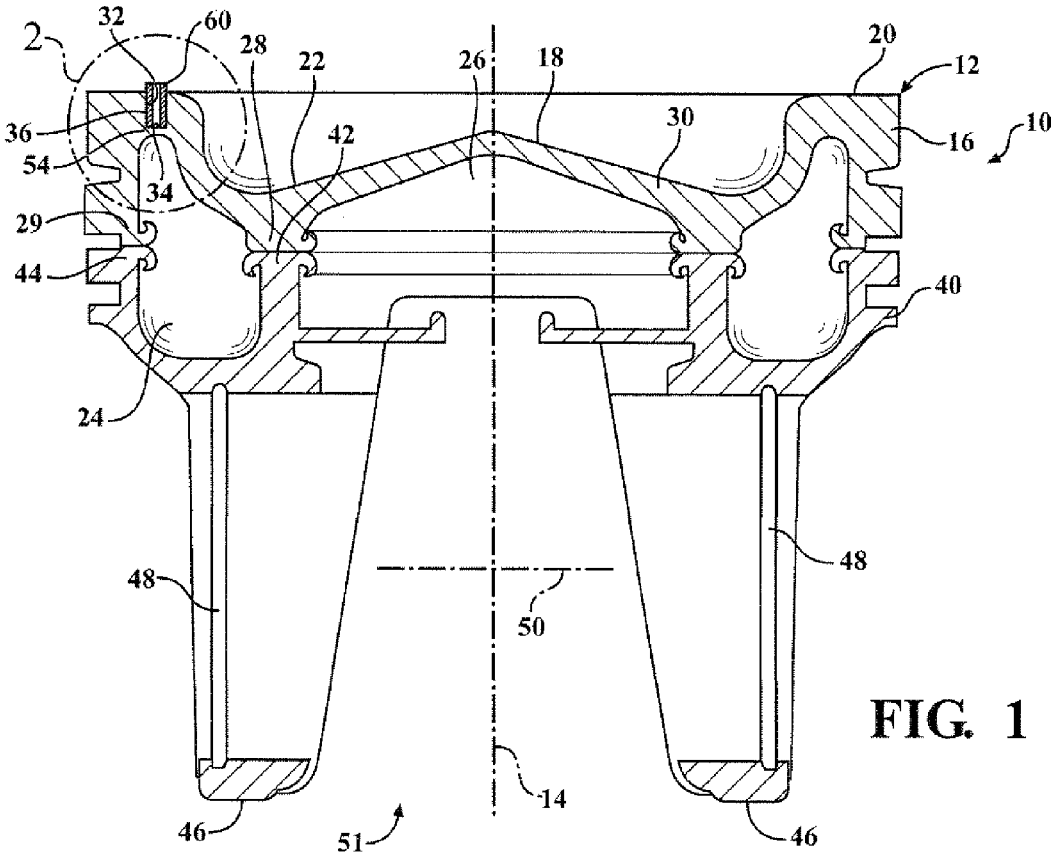
FIG. 1 illustrates a cross-sectional view of a piston constructed in accordance with one aspect of the invention in an internal combustion engine.
Figure 1A:
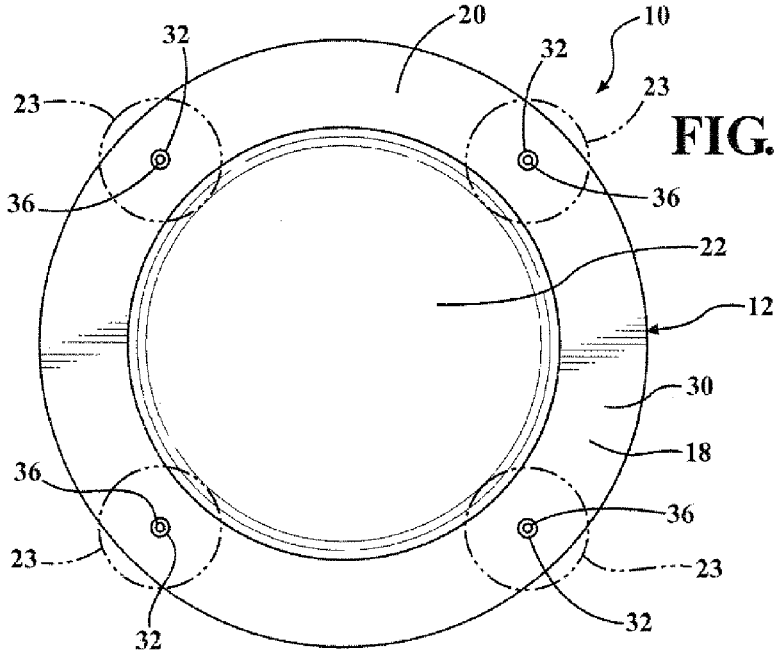
FIG. 1A is a plan view of the piston of FIG. 1 showing valve head locations positioned over an upper combustion surface of the piston.
Figure 3:
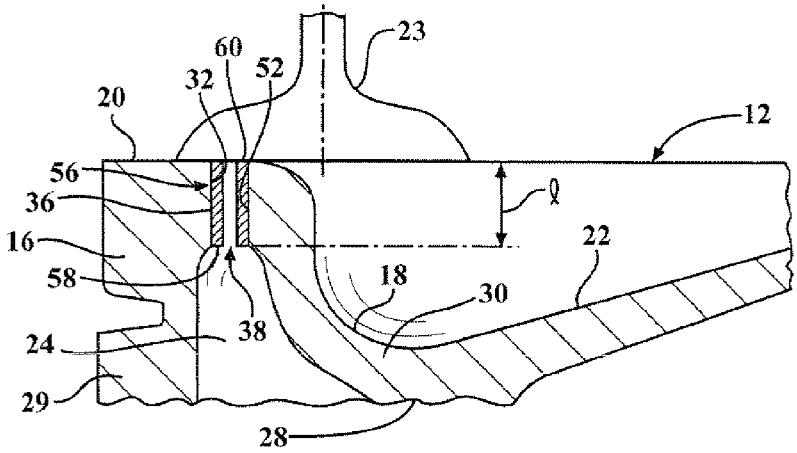
FIG. 3 is a view similar to FIGS. 2 and 2A showing a blow-by passage formed in the piston.

Referring in more detail to the drawings, FIG. 1 illustrates a piston 10 constructed in accordance with one presently preferred aspect of the invention. The piston 10 has a piston body 12 extending along a central axis 14 along which the piston 10 reciprocates within a cylinder bore (not shown). The piston body 12, by way of example and without limitation, includes an upper crown portion 16 having an upper combustion surface 18, represented here, by way of example and without limitation, as having an annular, planar, radially outer portion 20 and a recessed combustion bowl 22 radially inwardly from the outer portion 20. The outer portion 20 is configured to be aligned beneath a plurality of valve heads 23 (FIG. 1A). The piston 10 is shown as having internal outer and central cooling galleries or chambers 24, 26, respectively, separated from one another by an annular inner rib 28, by way of example and without limitation, with an annular outer rib 29 depending from the outer portion 20. The upper combustion surface 18 is separated from the outer and inner cooling galleries 24, 26 by an upper wall 30. At least one pocket, and preferably a number of pockets 32 corresponding with the number valve heads, shown as 4 in FIG. 1A, by way of example and without limitation, extends into the upper combustion surface 18 of the wall 30 over a depth (D) to a closed bottom surface 34 of the wall 30. A tubular member 36 is disposed in each one of the pockets 32 into abutment with the closed bottom surface 34. Upon being disposed into abutment with the bottom surface 34, or very close proximity thereto, the tubular member 36 extends upwardly from the upper combustion surface 18. Accordingly, should any one of the valve heads 23 become loose and drop from its normal functioning position, the respective valve head 23 impacts the underlying tubular member 36, thereby causing the tubular member 36 to impact the frangible closed bottom surface 34 with sufficient force to break through the frangible closed bottom surface 34, as shown in FIG. 3. As such, an intended orifice, also referred to as through passage or blow-by passage 38, is formed in a predetermined location through the upper wall 30. The blow-by passage 38 provides a sudden increase in gas/fuel mixture blow-by, thereby providing an immediate indication, such as can be detected by a pressure sensor sensing pressure within the cylinder bore, for example, of a problem. The indication of the sudden pressure change can be signaled to an operator or to an engine control system, thereby allowing the operator or the engine control system to shut down the engine to avoid further damage to the engine.

As shown in FIG. 1, the piston 10 can be constructed having, by way of example and without limitation, a lower crown portion 40 with a lower inner rib 42 and lower outer rib 44 arranged in axial alignment for fixed attachment with the upper inner and outer ribs 28, 29 to form the outer and inner cooling galleries 24, 26. A pair of pin bosses 46 depend from the upper crown portion 16 to provide a pair of wrist pin bores 48 aligned along a pin axis 50 for receipt of a wrist pin (not shown). A space 51 is provided between the pin bosses 46 for receipt of a small end of a connecting rod (not shown). It should be recognized that the cooling galleries 24, 26 could be formed other than as discussed and shown, and that rather than having dual galleries, a single cooling gallery could be provided.

Figure 2:
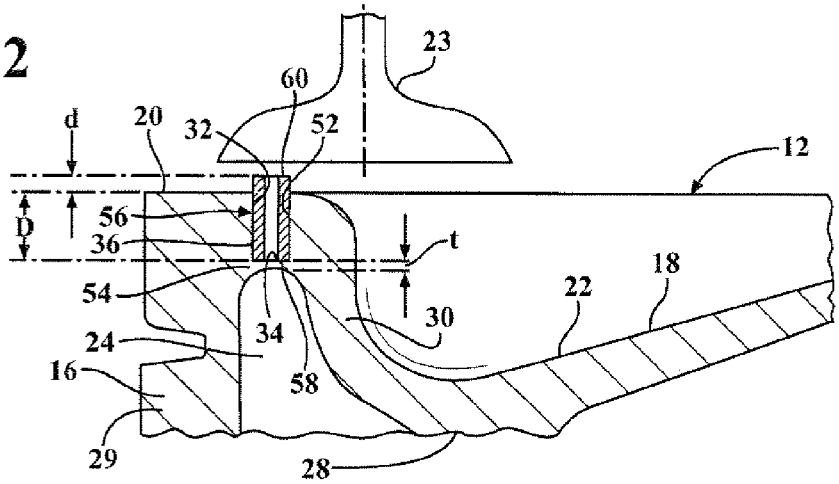
FIG. 2 is an enlarged view of an encircled portion 2 of the piston of FIG. 1.
Figure 2A:
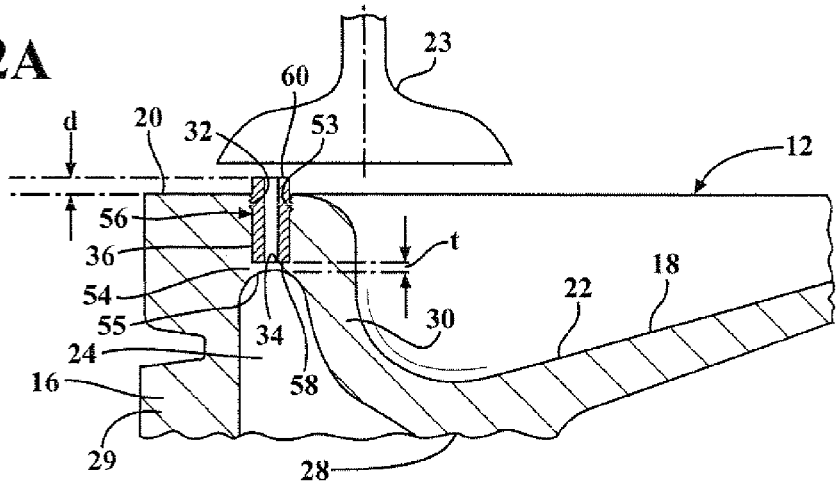
FIG. 2A is a view similar to FIG. 2 showing an alternate mechanism for fixing a tubular member in a pocket of the piston.

Each pocket 32 extends over the depth (D) extending from the upper combustion surface 18 to the closed bottom surface 34. The pockets 32 can be formed having a smooth inner wall 52 or they could be formed having a textured, knurled or threaded portion 53 (FIG. 2A), depending on the desired mechanism used to fix the tubular member 36 therein. The threaded portion 53 is shown as extending over about the upper half of the pocket 32, wherein the lower half remains unthreaded, for example. As such, the threads 53 provide sufficient retention of the tubular member 32 for normal operating conditions, while allowing the tubular member 32 to be driven downwardly under the impact of the overlying valve head 23. Accordingly, with only a portion of the pocket 32 being threaded, the tubular member is assured of being driven into the underlying cooling gallery 24 upon being impacted by the overlying valve head 23 should the valve head 23 drop from its normal functioning position. The inner wall 52 is preferably formed having a straight, cylindrical shape, for ease of manufacture, though, if desired, other shapes could be used. The pocket 32 provides a reduced thickness portion 54 of the wall 30, wherein the reduced thickness portion 54 has a predetermined thickness (t) extending between the bottom surface 34 of the pocket 32 and an underside 55.

The tubular member 36 has an outer surface 56, shown as being a straight, cylindrical surface, for example, configured for fixed receipt in the pocket 32. Accordingly, if inner wall 52 of the pocket 32 is smooth or substantially smooth, then the outer surface 56 can be sized for a tight fit, also referred to as press fit, in the pocket 32. Otherwise, an adhesive or mechanical attachment mechanism could be used to fix the tubular member 36 in the pocket 32, with the premise that the adhesion or mechanical attachment mechanism be selectively broken should the valve head 23 impact the tubular member 36. Further, if the inner wall 52 has a threaded portion (FIG. 2A), then the outer surface 56 of the tubular member 36 could likewise have a mating thread portion for threaded attachment in the pocket 32. Upon being fixed in the pocket 32, regardless of how, e.g. pressed tight fit, adhered, threaded, or otherwise, a bottom end 58 of the tubular member 36 is brought into abutment with or very close proximity to the bottom surface 34 of the pocket 32 and an upper end 60 of the tubular member 36 extends upwardly from the upper surface 18, shown here as extending upwardly from the planar outer portion 20. As such, the tubular member 36 is constructed having a predetermined length (l) that is greater than the depth D of the pocket 32 such that the upper end 60 is assured of extending upwardly above the upper combustion surface 18 of the outer portion 20 a predetermined distance (d) when the bottom surface 58 is abutting the bottom surface 34 of the pocket 32. The distance d is provided to be the at least the same as or slightly greater than the thickness t of the reduced thickness portion 54 of the wall 30. It should be understood that the upper end 60 does not interfere with the overlying, axially aligned valve head 23 or otherwise have an adverse affect on the performance of the engine during normal operating conditions.

If the overlying valve head 23 is lowered into the cylinder bore combustion chamber from its normal operating position (malfunction condition of the valve head 23) such that it abuts the upper end 60 of the underlying tubular member 36, the force generated drives the tubular member 36 downwardly into the pocket 32 and the reduced thickness, frangible portion 54 of the wall 30 is caused to be fractured under the driving force of the tubular member 36. As such, the tubular member 36 extends completely between the upper combustion surface 18 and the internal outer cooling gallery 24 to form the blow-by passage 38 (FIG. 3). The blow-by passage 38 is assured of being formed as a result of the dimensional relation between the wall thickness t and the distance d by which the tubular member 36 extends above the upper surface 20. At a minimum, when the upper end 60 of the tubular member 36 is brought flush, or substantially flush with the outer surface 20 as a result of being driven downwardly by the valve head 23, the bottom end 58 of the tubular member 36 is driven flush with or into the outer cooling gallery 24. Accordingly, the through passage extending through the tubular member 36 extends completely from the upper combustion surface 18 into the outer cooling gallery 24, thereby providing the open blow-by passage 38. As such, when this occurs, the amount of gas/fuel mixture blow-by increases given the gas/fuel mixture is free to flow through the through passage 38 into the cooling gallery 24, thereby promoting a loss or decrease of pressure signal to be sent to the operator and/or to a control unit, and in turn, allowing the operator and/or control unit to shut down the engine before the onset of further damage to the engine.

Obviously, many modifications and variations of the present invention are possible in light of the above teachings. It is, therefore, to be understood that within the scope of the appended claims, the invention may be practiced otherwise than as specifically described.

What is claimed is:

1. A piston, comprising:

a piston body having an upper combustion surface spaced from an internal cooling chamber by a wall, said wall having at least one pocket extending into said upper combustion surface toward said internal cooling chamber over a depth to a closed bottom surface, said closed bottom surface being spaced from said internal cooling chamber by a portion of said wall having a reduced thickness; and a tubular member disposed in said at least one pocket and extending upwardly from said upper combustion surface.

2. The piston of claim 1 wherein said tubular member extends upwardly from said upper combustion surface a distance equal to or greater than said reduced thickness.

3. The piston of claim 1 wherein said tubular member has a length greater than said depth.

4. The piston of claim 3 wherein said tubular member extends upwardly from said upper combustion surface a distance equal to or greater than said reduced thickness.

5. The piston of claim 1 wherein said tubular member has a straight, cylindrical outer surface.

6. The piston of claim 1 wherein said tubular member has an interference fit within said at least one pocket.

7. The piston of claim 1 wherein said tubular member is threaded within said at least one pocket.

8. The piston of claim 7 wherein said at least one pocket is threaded over a portion of its depth.

9. The piston of claim 1 wherein said piston body has a plurality of said pockets corresponding to the number of valve heads overlying said piston body.

10. The piston of claim 9 wherein each one of said pockets is aligned with a separate one of the valve heads.

11. A method of preventing catastrophic failure to an internal combustion engine, comprising:

providing a piston body having an upper combustion surface spaced from an internal cooling chamber by a wall; and providing at least one predetermined location in the wall for a through opening to extend from the upper combustion surface into the internal cooling chamber.

12. The method of claim 11 further including forming a pocket having a depth extending into the upper combustion surface to a closed bottom surface of the wall at the predetermined location and disposing a tubular member in the pocket with the tubular member extending upwardly from the upper surface.

13. The method of claim 12 further including forming the wall having a reduced thickness extending between the closed bottom surface and the internal cooling chamber and extending the tubular member upwardly from the upper combustion surface a distance equal to or greater than the reduced thickness.

14. The method of claim 12 further including providing the tubular member with a length greater than the depth of the pocket.

15. The method of claim 14 further including extending the tubular member upwardly from the upper combustion surface a distance equal to or greater than the reduced thickness.

16. The method of claim 12 further including providing the tubular member having a straight, cylindrical outer surface.

17. The method of claim 12 further including forming an interference fit between the tubular member and the pocket.

18. The method of claim 12 further including threading the tubular member into the pocket.

19. The method of claim 18 further including engaging threads of the tubular member and the pocket over a region less than the entire depth of the pocket.

20. The method of claim 12 further including forming the piston body having pockets corresponding in number with the number of valve heads overlying the piston body.

21. The method of claim 20 further including axially aligning each one of the pockets with a separate one of the valve heads.

* * * * *